US007118849B2

(12) United States Patent
Dickerson et al.

(10) Patent No.: US 7,118,849 B2
(45) Date of Patent: Oct. 10, 2006

(54) PHOTOTHERMOGRAPHIC MATERIALS WITH UV ABSORBING COMPOUNDS

(75) Inventors: Robert E. Dickerson, Hamlin, NY (US); Kurt M. Schroeder, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 23 days.

(21) Appl. No.: 10/896,108

(22) Filed: Jul. 21, 2004

(65) Prior Publication Data

US 2006/0019206 A1 Jan. 26, 2006

(51) Int. Cl.
*G03C 5/16* (2006.01)
*G03C 1/825* (2006.01)
*G03C 1/498* (2006.01)

(52) U.S. Cl. ..... 430/350; 430/139; 430/510; 430/512; 430/523; 430/619

(58) Field of Classification Search ..... 430/619, 430/510, 512, 523, 350, 139
See application file for complete search history.

(56) References Cited

U.S. PATENT DOCUMENTS

| | | | | |
|---|---|---|---|---|
| 4,540,656 | A | 9/1985 | Nishizima et al. | |
| 4,663,642 | A | 5/1987 | Kameda et al. | |
| 4,803,150 | A | 2/1989 | Dickerson et al. | |
| 4,886,774 | A | 12/1989 | Doi | |
| 5,028,518 | A | 7/1991 | Lyons et al. | |
| 5,401,622 | A | 3/1995 | Yamada | |
| 5,786,133 | A * | 7/1998 | Smith | 430/512 |
| 6,093,529 | A * | 7/2000 | Tsuzuki et al. | 430/619 |
| 6,184,375 | B1 | 2/2001 | Hüglin et al. | |
| 6,440,649 | B1 * | 8/2002 | Simpson et al. | 430/351 |
| 6,576,413 | B1 * | 6/2003 | Uytterhoeven et al. | 430/619 |
| 2002/0123016 | A1 * | 9/2002 | Hirabayashi | 430/350 |

FOREIGN PATENT DOCUMENTS

JP 03 091055 A 3/2003

OTHER PUBLICATIONS

U.S. Appl. No. 10/100,333 (D-84025), filed Mar. 18, 2002, titled "Transferable UV Protective Image Overcoat" by W.H. Simpson et al.
JP Abstract 2002-196450-A.
JP Abstract 2001-312025-A.
JP Abstract 11-327078-A.
JP Abstract 11-044930-A.
JP Abstract 05-150433-A.
JP Abstract 2-029741-A.
JP Abstract 2003-091055.
JP Abstract 2001-166419-A.

* cited by examiner

*Primary Examiner*—Thorl Chea
(74) *Attorney, Agent, or Firm*—J. Lanny Tucker; Louis M. Leichter

(57) ABSTRACT

Photothermographic materials are coated with imaging layers and an antihalation layer between the support and thermally developable imaging layers on one or both sides of the support. Such materials can be arranged in association with one or more phosphor intensifying screens capable of providing emission at a predetermined wavelength in imaging assemblies. These imaging assemblies can be exposed to X-radiation and thereby excited to form a latent image in the photothermographic material that can eventually be used for medical diagnosis. The antihalation layers contain radiation absorbing compounds (such as a UV-radiation absorbing compounds) that absorb radiation at the predetermined wavelength (for example at 300 to 450 nm) and have limited absorption at higher wavelengths.

34 Claims, No Drawings

PHOTOTHERMOGRAPHIC MATERIALS WITH UV ABSORBING COMPOUNDS

FIELD OF THE INVENTION

This invention relates to photothermographic materials comprising certain radiation absorbing compounds in an antihalation layer. More particularly, it relates to photothermographic materials having imaging layers on one or both sides of a support and radiation absorbing compounds in an antihalation layer underneath the imaging layers. This invention also relates to methods of using these imaging materials.

BACKGROUND OF THE INVENTION

Silver-containing photothermographic imaging materials (that is, thermally developable photosensitive imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

As pointed out above, there are considerable differences between conventional silver halide-containing photographic materials and silver halide-containing photothermographic materials. One critical difference is the relatively lower amounts of silver halide in the photothermographic materials. As a result, such materials are very transparent to imaging radiation, and may have poor resolution and edge sharpness due to low absorbance.

Photothermographic materials have been developed and commercialized by Eastman Kodak Company, which materials are sensitive to infrared or near-infrared radiation. While these products have found considerable commercial success, there is an interest in providing photothermographic materials that are sensitive in the visible or UV regions of the electromagnetic spectrum. However, because of the low absorbance of such materials, a lot of radiation will pass through the imaging layers to the backside. This "crossover" radiation, as it is known in the art, may be a concern if the material is imaged on one side only, and in the instances where both sides of the support have imaging layers, such crossover radiation will be a greater concern and may lead to reduced image sharpness.

Conventional "wet"-processed photographic materials are spectrally sensitized to provide absorption of imaging radiation including visible light emitted from phosphor intensifying screens. In addition, absorbing dyes can be used in various layers to reduce light transmittance or crossover as described in U.S. Pat. No. 4,803,150 (Dickerson et al.). These dyes, however, can be removed or decolorized during conventional "wet" photographic processing, thus reducing dye stain, $D_{min}$, and haze.

In photothermographic materials, however, light absorbing components cannot be removed during thermal processing and may cause "stain" or residual color in the resulting image. The addition of such components can also result in a loss in photospeed and/or image contrast.

There is a need in the art for away to improved image contrast in photothermographic materials without an unacceptable loss in photospeed and without causing dye stain, high $D_{min}$, or haze.

SUMMARY OF THE INVENTION

This invention provides a photothermographic material comprising a support and having on at least one side thereof one or more thermally developable imaging layers comprising a binder, and in reactive association, a photosensitive silver halide that is spectrally sensitized to a predetermined wavelength within a predetermined range of wavelengths, a non-photosensitive source of reducible silver ions, a reducing agent for the non-photosensitive reducible silver ions, and optionally an outermost protective layer disposed over the one or more thermally developable imaging layers, the material further comprising an antihalation layer interposed between the one or more thermally developable imaging layers and the support, the antihalation layer comprising a radiation-absorbing compound that absorbs radiation at the predetermined wavelength.

In preferred embodiments, this invention provides a black-and-white aqueous-based photothermographic material that comprises a transparent support having on at least one side thereof:

a) one or more thermally developable imaging layers each comprising a hydrophilic binder that is gelatin, a gelatin derivative, a poly(vinyl alcohol), or a cellulosic material, or is a water-dispersible polymeric latex, and in reactive association, a preformed photosensitive silver bromide, silver iodobromide, or a mixture thereof, provided predominantly as tabular grains, the tabular grains being spectrally sensitized to a predetermined wavelength within the predetermined range of wavelengths of from about 360 to about 420 nm, a non-photosensitive source of reducible silver ions that includes one or more organic silver salts at least one of which is a silver salt of benzotriazole, an ascorbic acid reducing agent for the non-photosensitive source of reducible silver ions, and b) optionally, an outermost protective layer disposed over the one or more thermally developable imaging layers, the material comprising an antihalation layer interposed between the one or more thermally developable imaging layers and the support, the antihalation layer comprising a UV radiation-absorbing compound, and the UV radiation-absorbing compound being one or more of the following compounds:

(I-1)

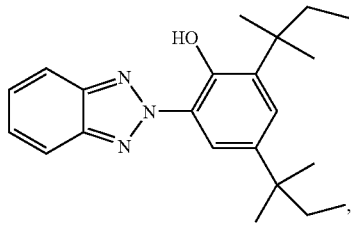

(II-1)

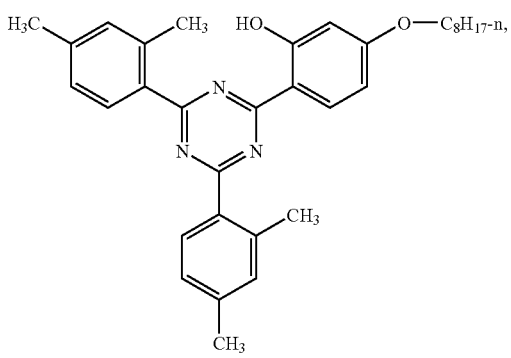

-continued (II-2)

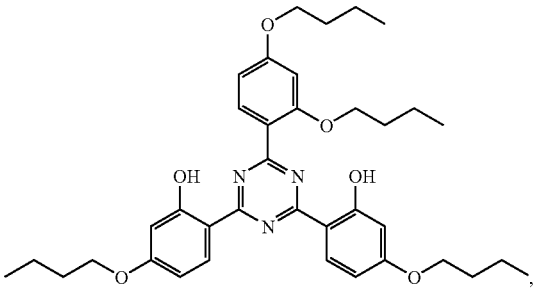

, and (III-1)

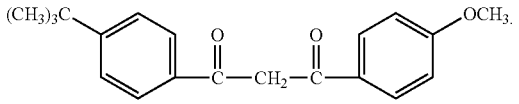

This invention also provides a black-and-white photothermographic material comprising a support having on a frontside thereof, a) one or more frontside thermally developable imaging layers comprising a hydrophilic polymer binder or water-dispersible polymer latex binder, and in reactive association, a photosensitive silver halide that is spectrally sensitized to a predetermined wavelength within a predetermined range of wavelengths, a non-photosensitive source of reducible silver ions that includes a silver salt of a heterocyclic compound containing an imino group, an ascorbic acid or reductone reducing agent for the non-photosensitive source reducible silver ions, and the material comprising on the backside of the support, one or more backside thermally developable imaging layers comprising a hydrophilic polymer binder or a water-dispersible polymer latex binder, and in reactive association, a photosensitive silver halide that is spectrally sensitized to a predetermined wavelength within a predetermined range of wavelengths, a non-photosensitive source of reducible silver ions that includes a silver salt of a heterocyclic compound containing an imino group, and an ascorbic acid or reductone reducing agent for the non-photosensitive source reducible silver ions, and b) optionally, an outermost protective layer disposed over the one or more thermally developable imaging layers on either or both sides of the support, and wherein the one or more thermally developable imaging layers, or the one or more protective layers if present, on both sides of the support have the same or different composition, and the material further comprising an antihalation layer on both sides of the support, the antihalation layer being interposed between the support and the one or more thermally developable imaging layers on each side of the support, the antihalation layers on both sides of the support having the same or different composition and comprising a UV radiation-absorbing compound that absorbs radiation at the predetermined wavelength and is a hydroxyphenylbenzotriazole, hydroxyphenyltriazine, dibenzoylmethane, or mixture thereof.

This invention also provides a method of forming a visible image comprising:

A) imagewise exposing the photothermographic material to form a latent image,

B) simultaneously or sequentially, heating the exposed photothermographic material to develop the latent image into a visible image.

Where the noted method is carried out using a photothermographic material comprising a transparent support, the image-forming method can further comprise:

C) positioning the exposed and thermally-developed material with the visible image therein between a source of imaging radiation and an imageable material that is sensitive to the imaging radiation, and D) exposing the imageable material to the imaging radiation through the visible image in the exposed and thermally-developed material to provide an image in the imageable material.

An imaging assembly comprises a photothermographic material that is arranged in association with one or more phosphor intensifying screens. A method of forming a black-and-white image can comprise exposing the imaging assembly to X-radiation and forming the image in the material from emission from the one or more screens.

The present invention is directed to certain black-and-white photothermographic materials that are sensitive to a predetermined wavelength in a predetermined range of wavelengths that is typically from about 300 to about 450 nm (preferably from about 360 to about 420 nm). These materials further include an antihalation layer under the imaging layers that contain a radiation-absorbing compound (especially a UV radiation-absorbing compound) that absorbs radiation at the predetermined wavelength. Thus, the materials can be imaged, for example, from the emission of a phosphor intensifying screen, preferably in the UV or blue region and the radiation-absorbing compound will absorb imaging radiation that is transmitted through the photothermographic material. The use of the radiation-absorbing compound results in increased image contrast without an undesirable loss in photospeed.

It is also desired that the radiation-absorbing compound cause minimal "yellow" stain since the compound are left in the material after imaging and processing. Stain results if a compound's absorption extends too far in the visible region of the electromagnetic spectrum.

DETAILED DESCRIPTION OF THE INVENTION

The photothermographic materials can be used in black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The photothermographic materials are particularly useful for medical imaging of human or animal subjects in response to visible or X-radiation for use in medical diagnosis. Such applications include, but are not limited to, thoracic imaging, mammography, dental imaging, orthopedic imaging, general medical radiography, therapeutic radiography, veterinary radiography, and auto-radiography.

Increased sensitivity to X-radiation can be imparted through the use of phosphors. When used with X-radiation, the photothermographic materials of this invention may be used in combination with one or more phosphor intensifying screens, with phosphors incorporated within the imaging layer(s), or with a combination thereof.

The photothermographic materials can be made sensitive to radiation of any suitable wavelength. Thus, in some embodiments, the materials are sensitive at ultraviolet, visible, near infrared, or infrared wavelengths of the electromagnetic spectrum. In these embodiments, the materials are preferably sensitive to radiation greater than 300 nm (such as sensitivity to, from about 300 to about 450 nm and preferably from about 360 nm to about 420 nm). Increased sensitivity to a particular region of the spectrum (such as the UV) is imparted through the use of various spectral sensitizing dyes.

The photothermographic materials are also useful for non-medical uses of visible or X-radiation (such as X-ray lithography and industrial radiography). In these and other imaging applications, it is particularly desirable that the photothermographic materials be "double-sided."

In some embodiments, the components needed for imaging can be in one or more imaging or emulsion layers on one side ("frontside") of the support. The layer(s) that contain the photosensitive photocatalyst (such as a photosensitive silver halide) or the non-photosensitive source of reducible silver ions, or both, are referred to herein as the imaging or emulsion layer(s). The photocatalyst and non-photosensitive source of reducible silver ions are in catalytic proximity and preferably are in the same emulsion layer. Various non-imaging layers can also be disposed on the "backside" (non-emulsion or non-imaging side) of the materials, including conductive layers, antihalation layer(s), protective layers, antistatic layers, and transport enabling layers.

Various non-imaging layers can also be disposed on the "frontside" or imaging or emulsion side of the support, including protective topcoat layers, primer layers, interlayers, opacifying layers, antistatic layers, acutance layers, auxiliary layers, and other layers readily apparent to one skilled in the art.

In preferred embodiments, the photothermographic materials are "double-sided" or "duplitized" and have the same or different emulsion coatings (or imaging layers) on both sides of the support. In such constructions each side can also include one or more protective topcoat layers, primer layers, interlayers, antistatic layers, acutance layers, antihalation layers, auxiliary layers, conductive layers, and other layers readily apparent to one skilled in the art. Preferably, the thermally developable imaging layers and antihalation layers are the same on both sides of the support.

When the photothermographic materials are heat-developed as described below in a substantially water-free condition after, or simultaneously with, imagewise exposure, a silver image (preferably a black-and-white silver image) is obtained.

Definitions

As used herein:

In the descriptions of the photothermographic materials, "a" or "an" component refers to "at least one" of that component (for example, the radiation absorbing compounds).

Unless otherwise indicated, when the terms "photothermographic material" and "imaging assembly" are used herein, it is in reference to embodiments of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of emulsion layers wherein the photosensitive silver halide and the source of reducible silver ions are in one layer and the other imaging components or desirable additives are distributed, as desired, in the same layer or in an adjacent coated layer. These materials also include multilayer constructions in which one or more imaging components are in different layers, but are in "reactive association." For example, one layer can include the non-photosensitive source of reducible silver ions and another layer can include the reducing agent and/or photosensitive silver halide.

The term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the materials are in the same layer or in adjacent layers so that they readily come into contact with each other during thermal imaging and development.

"Emulsion layer," "thermally developable imaging layer," or "photothermographic emulsion layer," means a layer of a photothermographic material that contains the photosensitive silver halide and/or non-photosensitive source of reducible silver ions. It can also mean a layer of the material that contains, in addition to the photosensitive silver halide and/or non-photosensitive source of reducible ions, additional imaging components and/or desirable additives such as the reducing agent(s). These layers are usually on what is known as the "frontside" of the support but preferably, they are on both sides of the support.

In addition, "frontside" also generally means the side of a photothermographic material that is first exposed to imaging radiation, and "backside" generally refers to the opposite side of the support.

"Photocatalyst" means a photosensitive compound such as silver halide that, upon exposure to radiation, provides a compound that is capable of acting as a catalyst for the subsequent development of the photothermographic material.

Many of the chemical components used herein are provided as a solution. The term "active ingredient" means the amount or percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 nm to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

The sensitometric term "absorbance" is another term for optical density (OD).

The sensitometric terms "photospeed," (also known as sensitivity), absorbance, contrast, $D_{min}$, and $D_{max}$ have conventional definitions known in the imaging arts. $D_{min}$ is considered herein as image density achieved when the photothermographic material is thermally developed without prior exposure to radiation. $D_{max}$ is the maximum density of film in the imaged area.

As used herein, the phrase "organic silver coordinating ligand" refers to an organic molecule capable of forming a bond with a silver atom. Although the compounds so formed are technically silver coordination compounds they are also often referred to as silver salts.

In the compounds described herein, no particular double bond geometry (for example, cis or trans) is intended by the structures drawn unless otherwise specified. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), hydroxyalkyl (such as 1,2-dihydroxyethyl), haloalkyl, nitroalkyl, alkylcarboxy, carboxyalkyl, carboxamido, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

"Symmetric" photothermographic materials are those materials having essentially the same imaging and non-imaging layers on both sides of the support. "Asymmetric" photothermographic materials are those materials having different imaging layers or other layers on both sides of the support such that each side of the material has substantially different sensitometric properties.

"Crossover" refers to radiation that passes through the imaging layer(s) and support to the opposite side of the support.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

The photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred silver halides, with the latter silver halide having up to 10 mol % silver iodide based on total silver halide.

In some embodiments, higher amounts of iodide may be present in the photosensitive silver halide grains up to the saturation limit of iodide as described in U.S. Patent Application Publication 2004/0053173 (Maskasky et al.), incorporated herein by reference.

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred. More preferably, the silver halide grains are predominantly (at least 50% based on total silver halide) present as tabular grains.

The silver halide grains may have a uniform ratio of halide throughout. They may have a graded, halide content, with a continuously varying ratio of, for example, silver bromide and silver iodide, or they may be of the core-shell type, having a discrete core of one or more silver halides, and a discrete shell of one of more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetraazaindene or an N-heterocyclic compound comprising at least one mercapto group as described in U.S. Pat. No. 6,413,710 (Shor et al.), that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process, and then be added to and physically mixed with the non-photosensitive source of reducible silver ions.

It is also possible to form the source of reducible silver ions in the presence of ex-situ-prepared silver halide. In this process, the source of reducible silver ions, such as a silver salt of an imino compound, is formed in the presence of the preformed silver halide grains. Co-precipitation of the reducible source of silver ions in the presence of silver halide provides a more intimate mixture of the two materials [see, for example U.S. Pat. No. 3,839,049 (Simons)] to provide a "preformed emulsion."

It is also effective to use an in-situ process in which a halide- or halogen-containing compound is added to an organic silver salt to partially convert the silver of the organic silver salt to silver halide. Inorganic halides (such as zinc bromide, calcium bromide, lithium bromide, or zinc iodide) or an organic halogen-containing compound (such as N-bromosuccinimide or pyridinium hydrobromide perbromide) can be used. The details of such in-situ generation of silver halide are well known and described for example in U.S. Pat. No. 3,457,075 (Morgan et al.).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), JP Kokai 49-013224, (Fuji), 50-017216 (Fuji), and 51-042529 (Fuji).

In general, the non-tabular silver halide grains can vary in average diameter of up to several micrometers (μm) and they usually have an average particle size of from about 0.01 to about 1.5 μm (preferably from about 0.03 to about 1.0 μm, and more preferably from about 0.05 to about 0.8 μm).

The average size of the photosensitive silver halide grains is expressed by the average diameter if the grains are spherical, and by the average of the diameters of equivalent circles for the projected images if the grains are cubic, tabular, or other non-spherical shapes. Representative grain sizing methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

In most preferred embodiments of this invention, the silver halide grains are provided predominantly (based on at least 50 mol % silver) as tabular silver halide grains that are considered "ultrathin" and have an average thickness of at least 0.02 μm and up to and including 0.10 μm (preferably, an average thickness of at least 0.03 μm and more preferably of at least 0.04 μm, and up to and including 0.08 μm and more preferably up to and including 0.07 μm).

In addition, these ultrathin tabular grains have an equivalent circular diameter (ECD) of at least 0.5 μm (preferably at least 0.75 μm, and more preferably at least 1 μm). The ECD can be up to and including 8 μm (preferably up to and including 6 μm, and more preferably up to and including 4 μm).

The aspect ratio of the useful tabular grains is at least 5:1 (preferably at least 10:1, and more preferably at least 15:1) and generally up to 50:1. The grain size of ultrathin tabular grains may be determined by any of the methods commonly employed in the art for particle size measurement, such as those described above.

The ultrathin tabular silver halide grains can also be doped using one or more of the conventional metal dopants known for this purpose including those described in *Research Disclosure* item 38957, September, 1996 and U.S. Pat. No. 5,503,970 (Olm et al.), incorporated herein by reference. Preferred dopants include iridium (III or IV) and ruthenium (II or III) salts.

Mixtures of both in-situ and ex-situ silver halide grains may be used.

The one or more light-sensitive silver halides used in the photothermographic materials of the present invention are preferably present in an amount of from about 0.005 to about 0.5 mole (more preferably from about 0.01 to about 0.25 mole, and most preferably from about 0.03 to about 0.15 mole) per mole of non-photosensitive source of reducible silver ions.

Chemical Sensitizers

The photosensitive silver halides used in photothermographic materials can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures and compounds are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), and U.S. Pat. No. 5,691,127 (Daubendiek et al.), and EP 0 915 371 A1 (Lok et al.), all incorporated herein by reference.

Certain substituted or and unsubstituted thioureas can be used as chemical sensitizers including those described in U.S. Pat. No. 6,296,998 (Eikenberry et al.), U.S. Pat. No. 6,322,961 (Lam et al.), U.S. Pat. No. 4,810,626 (Burgmaier et al.), and U.S. Pat. No. 6,368,779 (Lynch et al.), all of the which are incorporated herein by reference.

Still other useful chemical sensitizers include tellurium- and selenium-containing compounds that are described in U.S. Published Application 2002-0164549 (Lynch et al.), and U.S. Pat. No. 5,158,892 (Sasaki et al.), U.S. Pat. No. 5,238,807 (Sasaki et al.), U.S. Pat. No. 5,942,384 (Arai et al.) and U.S. Pat. No. 6,620,577 (Lynch et al.), all of which are incorporated herein by reference.

Noble metal sensitizers for use in the present invention include gold, platinum, palladium and iridium. Gold (+1 or +3) sensitization is particularly preferred, and described in U.S. Pat. No. 5,858,637 (Eshelman et al.) and U.S. Pat. No. 5,759,761 (Lushington et al.). Combinations of gold(III) compounds and either sulfur- or tellurium-containing compounds are useful as chemical sensitizers and are described in U.S. Pat. No. 6,423,481 (Simpson et al.). All of the above references are incorporated herein by reference.

In addition, sulfur-containing compounds can be decomposed on silver halide grains in an oxidizing environment. Examples of such sulfur-containing compounds include sulfur-containing spectral sensitizing dyes described in U.S. Pat. No. 5,891,615 (Winslow et al.) and diphenylphosphine sulfide compounds represented by the Structure (PS) described U.S. Patent Application Publication 2005/0123870 (Simpson et al.) both of which are incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic materials are spectrally sensitized with one or more spectral sensitizing dyes that are known to enhance silver halide sensitivity to a predetermined wavelength and preferably at a predetermined ultraviolet and/or visible radiation wavelength, within a predetermined range of wavelengths. Generally, the photosensitive silver halide in the materials are spectrally sensitized to a wavelength within the range of from about 360 to about 420 nm, and more preferably, within the range of from about 380 to about 420 nm.

Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved.

Dyes may also be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the photothermographic materials can be any metal-organic compound that contains reducible silver(I) ions. Such compounds are generally organic silver salts of organic silver coordinating ligands that are comparatively stable to light and form a silver image when heated to 50° C. or higher in the presence of an exposed silver halide (for photothermographic materials) and a reducing agent.

Particularly useful silver salts include silver salts of heterocyclic compounds containing mercapto or thione groups and derivatives thereof. Such heterocyclic nuclei include, but are not limited to, triazoles, oxazoles, thiazoles, thiazolines, imidazoles, diazoles, pyridines, and triazines as described in U.S. Pat. No. 4,123,274 (Knight et al.) and U.S. Pat. No. 3,785,830 (Sullivan et al.). Examples of other useful silver salts of mercapto or thione substituted compounds that do not contain a heterocyclic nucleus include silver salts of thioglycolic acids, silver salts of dithiocarboxylic acids, and silver salts of thioamides.

Silver salts of organic acids including silver salts of long-chain aliphatic or aromatic carboxylic acids may also be used. The aliphatic acids generally include chains of 10 to 30, and preferably 15 to 28, carbon atoms. Silver behenate is a preferred silver carboxylate, alone or mixed with other silver carboxylates.

Silver salts of nitrogen-containing heterocyclic compounds are preferred and generally comprise at least 50 mol % of the organic silver salts in the material. One or more silver salts of compounds containing an imino group are particularly preferred, especially in the aqueous-based materials that are preferred in this invention. Representative compounds of this type include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazole and imidazole derivatives as described in U.S. Pat. No. 4,260,677 (Winslow et al.). Particularly useful silver salts of this type are the silver salts of benzotriazole, substituted derivatives thereof, or mixtures of two or more of these salts. A silver salt of benzotriazole is most preferred in the photothermographic materials.

Particularly useful organic silver salts and methods of preparing them are described in U.S. Patent Application Publication 2005/0233,268 (Zou et al.) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm.

Sources of reducible silver ions can also be core-shell silver salts as described in U.S. Pat. No. 6,355,408 (Whitcomb et al.), that is incorporated herein by reference wherein a core has one or more silver salts and a shell has one or more different silver salts.

Other useful sources of non-photosensitive reducible silver ions are the silver dimer compounds that comprise two different silver salts as described in U.S. Pat. No. 6,566,045 (Whitcomb), that is incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Patent Application Publication 2004/0023164 (Bokhonov et al.) that is incorporated herein by reference.

The one or more non-photosensitive sources of reducible silver ions are preferably present in an amount of about 5% by weight to about 70% by weight, and more preferably, about 10% to about 50% by weight, based on the total dry weight of the emulsion layers. Alternatively, the amount of the sources of reducible silver ions is generally present in an amount of from about 0.001 to about 0.2 mol/m$^2$ of the dry photothermographic material (preferably from about 0.01 to about 0.05 mol/m$^2$).

The total amount of silver (from all silver sources) in the photothermographic materials is generally at least 0.002 mol/m$^2$ and preferably from about 0.01 to about 0.05 mol/m$^2$. The amount of silver in the thermographic materials of this invention is generally 0.02 mol/m$^2$.

Reducing Agents

While any compound that reduces silver ions may be useful in the present invention, the predominant reducing agents (or "developers") useful in this invention are ascorbic acid compounds (or derivatives) or reductones.

An "ascorbic acid" reducing agent means ascorbic acid and complexes, analogues, isomers, and derivatives thereof. Such ascorbic acid reducing agents are described in a considerable number of publications in photographic processes, including U.S. Pat. No. 5,236,816 (Purol et al.) and references cited therein. Such compounds include, but are not limited to, D- or L-ascorbic acid, 2,3-dihydroxy-2-cyclohexen-1-one, 3,4-dihydroxy-5-phenyl-2(5H)-furanone, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, niacinamide ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in EP 0 585 792 A1 (Passarella et al.), EP 0 573 700 A1 (Lingier et al.), EP 0 588 408 A1 (Hieronymus et al.), U.S. Pat. No. 5,498,511 (Yamashita et al.), U.S. Pat. No. 5,089,819 (Knapp), U.S. Pat. No. 5,278,035 (Knapp), U.S. Pat. No. 5,384,232 (Bishop et al.), and U.S. Pat. No. 5,376,510 (Parker et al.), J P Kokai 7-56286 (Toyoda), U.S. Pat. No. 2,688,549 (James et al.), and *Research Disclosure*, publication 37152, March 1995. Mixtures of these developing agents can be used if desired.

Particularly useful reducing agents are ascorbic acid mono- or di-fatty acid esters such as the monolaurate, monomyristate, monopalmitate, monostearate, monobehenate, diluarate, distearate, dipalmitate, dibehenate, and dimyristate derivatives of ascorbic acid as described in U.S. Pat. No. 3,832,186 (Masuda et al.) and U.S. Pat. No. 6,309,814 (Ito). A most preferred reducing acid of this type is L-ascorbic acid, 6-(2,2-dimethylpropanoate).

Also useful as reducing agents are ascorbic acid derivatives that are represented by the following Structure (IV):

(IV)

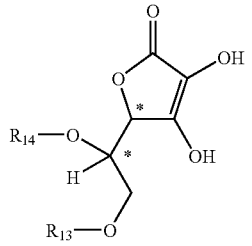

wherein $R_{13}$ and $R_{14}$ are independently hydrogen and/or the same or different acyl groups [$R_{15}$—(C═O)— or $R_{15}$-L-(C═O)—], provided that $R_{13}$ and $R_{14}$ are not both hydrogen. The acyl groups each have 11 or fewer carbon atoms, and preferably each acyl group is branched and/or contains at least one ring. The acyl groups may be substituted with functional groups such as ethers, halogens, esters and amides.

$R_{15}$ of the acyl group may be hydrogen, or a substituted or unsubstituted alkyl group having 10 or fewer carbon atoms (such as methyl, ethyl, iso-propyl, t-butyl, and benzyl), substituted or unsubstituted aryl having 6 to 10 carbon atoms in the carbocyclic ring (such as phenyl, 4-methylphenyl, 4-methoxyphenyl, and naphthyl), substituted or unsubstituted alkenyl having 10 or fewer carbon atoms in the chain (such as ethenyl, hexenyl, and 1-methylpropenyl), or a substituted or unsubstituted heterocyclic group having 5 to 7 nitrogen, oxygen, sulfur, and carbon atoms in the heterocyclic ring (such as tetrahydrofuryl and benzthiazoyl). L may be oxy, thio, or —$NR_{16}$—, wherein $R_{16}$ is defined in the same way as $R_{15}$.

At least one of $R_{13}$ and $R_{14}$ is an acyl group and the other of $R_{13}$ and $R_{14}$ is preferably hydrogen. Preferably, $R_{15}$ is tert-butyl, $R_{16}$ is hydrogen, and L is nitrogen.

Mixtures of these compounds can be used if desired in any specific proportion.

Compounds of Structure (IV) have two chiral centers (indicated by *). Therefore four isomers are possible and compounds of Structure IV may be derived from D- or L-ascorbic acid or from D- or L-isoascorbic acid.

Representative examples of compounds having Structure IV are shown below in TABLE I.

TABLE I

| Compound | Derived From | $R_{13}$ | $R_{14}$ |
|---|---|---|---|
| IV-1 | L-ascorbic acid | t-Butyl-(C═O)— | H |
| IV-2 | D-isoascorbic acid | t-Butyl-(C═O)— | H |
| IV-3 | L-ascorbic acid | t-Butyl-(C═O)— | t-Butyl-(C═O)— |
| IV-4 | D-isoascorbic acid | t-Butyl-(C═O)— | t-Butyl-(C═O)— |
| IV-5 | D-isoascorbic acid | H | t-Butyl-(C═O)— |
| IV-6 | L-ascorbic acid | i-Propyl-(C═O)— | H |
| IV-7 | L-ascorbic acid | Ph-(C═O)— | H |
| IV-8 | L-ascorbic acid | 1-Adamantyl-(C═O)— | H |
| IV-9 | L-ascorbic acid | 1-Adamantylmethyl-(C═O)— | H |
| IV-10 | L-ascorbic acid | 1-Methylcyclohexyl-(C═O)— | H |
| IV-11 | L-ascorbic acid | 2-Adamantylmethyl-(C═O) | H |
| IV-12 | L-ascorbic acid | 2,2-Dimethylpropyl-(C═O)— | H |
| IV-13 | L-ascorbic acid | Cyclohexyl-(C═O)— | H |
| IV-14 | L-ascorbic acid | 1,1-Dimethylpropyl-(C═O)— | H |
| IV-15 | L-ascorbic acid | 1-Ethylpropyl-(C═O)— | H |
| IV-16 | L-ascorbic acid | 2,4,4-Trimethylpentyl-(C═O)— | H |
| IV-17 | L-ascorbic acid | 2-Methylpropyl-(C═O)— | H |
| IV-18 | L-ascorbic acid | Cyclopentyl-(C═O)— | H |
| IV-19 | L-ascorbic acid | Diethylamino-(C═O) | H |

TABLE I-continued

| Compound | Derived From | $R_{13}$ | $R_{14}$ |
|---|---|---|---|
| IV-20 | L-ascorbic acid | Diethylamino-(C═O)— | Diethylamino-(C═O)— |
| IV-21 | L-ascorbic acid | Phenyl-NH—(C═O)— | H |
| IV-22 | L-ascorbic acid | Hexyl-NH—(C═O)— | Hexyl-NH—(C═O)— |
| IV-23 | L-ascorbic acid | t-Butyl-(C═O)— | Ethyl-(C═O)— |
| IV-24 | L-ascorbic acid | Ethyl-(C═O)— | Ethyl-(C═O)— |
| IV-25 | L-ascorbic acid | Ethyl-O—(C═O)— | H |
| IV-26 | L-ascorbic acid | Phenyl-O—(C═O)— | H |
| IV-27 | L-ascorbic acid | 4-HO-Phenyl-(C═O)— | H |
| IV-28 | L-ascorbic acid | 2-norbornylmethyl-(C═O)— | H |
| IV-29 | L-ascorbic acid | 3,4-$(HO)_2$-Phenyl-(C═O)— | H |
| IV-30 | L-ascorbic acid | i-Propyl-(C═O)— | i-Propyl-(C═O)— |
| IV-31 | L-ascorbic acid | Ethyl-(C═O)— | Ethyl-(C═O)— |

The compounds of Structure IV may be prepared using known methods. For example, 5- and/or 6-substituted esters of ascorbic acid may be prepared by the method described by Tanaka et al., *Yakugaku Zasshi,* 1966, 86(5), 376–83.

A "reductone" reducing agent means a class of unsaturated, di- or poly-enolic organic compounds which, by virtue of the arrangement of the enolic hydroxyl groups with respect to the unsaturated linkages, possess characteristic strong reducing power. The parent compound, "reductone" is 3-hydroxy-2-oxo-propionaldehyde (enol form) and has the structure HOCH═CH(OH)—CHO. In some reductones, an amino group, a mono-substituted amino group or an imino group may replace one or more of the enolic hydroxyl groups without affecting the characteristic reducing behavior of the compound.

Reductone developing agents are described in a considerable number of publications in photographic processes, including U.S. Pat. No. 2,691,589 (Henn et al), U.S. Pat. No. 3,615,440 (Bloom), U.S. Pat. No. 3,664,835 (Youngquist et al.), U.S. Pat. No. 3,672,896 (Gabrielson et al.), U.S. Pat. No. 3,690,872 (Gabrielson et al.), U.S. Pat. No. 3,816,137 (Gabrielson et al.), U.S. Pat. No. 4,371,603 (Bartels-Keith et al.), U.S. Pat. No. 5,712,081 (Andriesen et al.), and U.S. Pat. No. 5,427,905 (Freedman et al.), all of which references are incorporated herein by reference.

Other reducing agents (defined below) can also be used, but it is preferred that they are present in minor amounts (less than 20 mol % of total moles of reducing agents) only. Such reducing agents include hindered phenols.

If desired, co-developers and contrast enhancing agents may be used in combination with the ascorbic acid and reductone reducing agents described herein. Useful co-developer reducing agents include for example, those described in U.S. Pat. No. 6,387,605 (Lynch et al.) that is incorporated herein by reference.

Additional classes of reducing agents that may be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are identified as HET-01 and HET-02 in U.S. Pat. No. 5,635,339 (Murray) and CN-01 through CN-13 in U.S. Pat. No. 5,545,515 (Murray et al.), both incorporated herein by reference.

Various contrast enhancing agents may be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described in U.S. Pat. No. 5,545,505 (Simpson), hydroxamic acid compounds as described in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) is generally present in the photothermographic materials in an amount of from about 0.3 to about 1.0 mol/mol of total silver, or in an amount of from about 0.002 to about 0.05 mol/$m^2$ (preferably from about 0.006 to about 0.03 mol/$m^2$).

Other Addenda

The photothermographic materials can also include one or more compounds that are known in the art as "toners." Toners are compounds that when added to the imaging layer shift the color of the developed silver image from yellowish-orange to brown-black or blue-black, and/or act as development accelerators to speed up thermal development. "Toners" or derivatives thereof that improve the black-and-white image are highly desirable components of the photothermographic materials.

Thus, compounds that either act as toners or react with a reducing agent to provide toners can be present in an amount of about 0.01% by weight to about 10% (preferably from about 0.1% to about 10% by weight) based on the total dry weight of the layer in which they are included. The amount can also be defined as being within the range of from about $1\times10^{-5}$ to about 1.0 mol per mole of non-photosensitive source of reducible silver in the photothermographic material. The toner compounds may be incorporated in one or more of the thermally developable imaging layers as well as in adjacent layers such as a protective overcoat layer or underlying "carrier" layer. Toners can be located on both sides of the support if thermally developable imaging layers are present on both sides of the support.

Compounds useful as toners are described, for example, in U.S. Pat. No. 3,074,809 (Owen), U.S. Pat. No. 3,080,254 (Grant, Jr.), U.S. Pat. No. 3,446,648 (Workman), U.S. Pat. No. 3,844,797 (Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282

(Winslow), U.S. Pat. No. 5,599,647 (Defieuw et al.), and U.S. Pat. No. 3,832,186 (Masuda et al.), and GB 1,439,478 (AGFA).

Particularly useful toners are mercaptotriazoles as described in U.S. Pat. No. 6,713,240 (Lynch et al.), the heterocyclic disulfide compounds described in U.S. Pat. No. 6,737,227 (Lynch et al.), the triazine-thione compounds described in U.S. Pat. No. 6,703,191 (Lynch et al.). All of the above are incorporated herein by reference.

Also useful as toners are phthalazine and phthalazine derivatives [such as those described in U.S. Pat. No. 6,146,822 (Asanuma et al.) incorporated herein by reference], phthalazinone, and phthalazinone derivatives as well as phthalazinium compounds [such as those described in U.S. Pat. No. 6,605,418 (Ramsden et al.), incorporated herein by reference].

The photothermographic materials can also contain other additives such as shelf-life stabilizers, antifoggants, contrast enhancing agents, development accelerators, acutance dyes, post-processing stabilizers or stabilizer precursors, thermal solvents (also known as melt formers), humectants, and other image-modifying agents as would be readily apparent to one skilled in the art.

To further control the properties of photothermographic materials (for example, contrast, $D_{min}$, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Useful heteroaromatic mercapto compounds are described as supersensitizers in EP 0 559 228 B1 (Philip et al.).

The photothermographic materials can be further protected against the production of fog and can be stabilized against loss of sensitivity during storage. Suitable antifoggants and stabilizers that can be used alone or in combination include thiazolium salts as described in U.S. Pat. No. 2,131,038 (Brooker et al.) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), oximes as described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful for post-processing print stabilizing as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, et al.), diisocyanate compounds as described in EP 0 600 586A1 (Philip et al.), and tribromomethylketones as described in EP 0 600 587A1 (Oliff et al.).

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants of this type are polyhalo antifoggants, such as those having a —$SO_2C(X')_3$ group wherein X' represents the same or different halogen atoms.

Another class of useful antifoggants includes those compounds described in U.S. Pat. No. 6,514,678 (Burgmaier et al.), incorporated herein by reference.

The photothermographic materials can also include one or more thermal solvents (also called "heat solvents," "thermosolvents," "melt formers," "melt modifiers," "eutectic formers," "development modifiers," "waxes," or "plasticizers").

By the term "thermal solvent" is meant an organic material that becomes a plasticizer or liquid solvent for at least one of the imaging layers upon heating at a temperature above 60° C. Useful for that purpose are polyethylene glycols having a mean molecular weight in the range of 1,500 to 20,000 described in U.S. Pat. No. 3,347,675 (Henn et al.), urea, methyl sulfonamide and ethylene carbonate as described in U.S. Pat. No. 3,667,959 (Bojara et al.), and compounds described as thermal solvents in *Research Disclosure*, December 1976, item 15027, pp. 26–28. Other representative examples of such compounds include, but are not limited to, niacinamide, hydantoin, 5,5-dimethylhydantoin, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, 1,3-dimethylurea, 1,3-diethylurea, 1,3-diallylurea, meso-erythritol, D-sorbitol, tetrahydro-2-pyrimidone, glycouril, 2-imidazolidone, 2-imidazolidone-4-carboxylic acid, and benzenesulfonamide. Combinations of these compounds can also be used including, for example, a combination of succinimide and 1,3-dimethylurea.

It may be advantageous to include a base-release agent or base precursor in the photothermographic materials. Representative base-release agents or base precursors include guanidinium compounds, such as guanidinium trichloroacetate, and other compounds that are known to release a base but do not adversely affect photographic silver halide materials, such as phenylsulfonyl acetates as described in U.S. Pat. No. 4,123,274 (Knight et al.).

It may also be useful to incorporate X-radiation-sensitive phosphors in the photothermographic materials as described in U.S. Pat. No. 6,573,033 (Simpson et al.) and U.S. Pat. No. 6,440,649 (Simpson et al.).

Binders

The photosensitive silver halide (if present), the non-photosensitive source of reducible silver ions, the reducing agent, antifoggant(s), toner(s), and any other additives used in the present invention are added to and coated in one or more binders using a suitable solvent. Thus, organic solvent-based or aqueous-based formulations are used to prepare the photothermographic materials. Mixtures of different types of hydrophilic and/or hydrophobic binders can also be used. Preferably, hydrophilic binders and water-dispersible polymeric latexes are used to provide aqueous-based materials.

Examples of useful hydrophilic binders include, but are not limited to, proteins and protein derivatives, gelatin and gelatin derivatives (hardened or unhardened), cellulosic materials, acrylamide/methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides, and other naturally occurring or synthetic vehicles commonly known for use in aqueous-based photographic emulsions (see for example *Research Disclosure*, item 38957, noted above).

Particularly useful hydrophilic binders are gelatin, gelatin derivatives, polyvinyl alcohols, and cellulosic materials. Gelatin and its derivatives are most preferred and comprise at least 75 weight % of total binders when a mixture of binders is used.

Aqueous dispersions of water-dispersible polymeric latexes may also be used, alone or with hydrophilic or hydrophobic binders described herein. Such dispersions are described in, for example, U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al:), and U.S. Pat. No. 6,423,487 (Naoi), all of which are incorporated herein by reference.

In some embodiments, the components needed for imaging can be added to one or more binders that are predominantly (at least 50% by weight of total binders) hydrophobic in nature. Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available under the name BUTVAR® from Solutia, Inc. (St. Louis, Mo.) and PIOLOFORM® from Wacker Chemical Company (Adrian, Mich.) and cellulose ester polymers.

Hardeners for various binders may be present if desired. Useful hardeners are well known and include diisocyanate compounds as described for example, in EP 0 600 586B1 (Philip et al.) and vinyl sulfone compounds as described in U.S. Pat. No. 6,143,487 (Philip et al.), and EP 0 640 589A1 (Gathmann et al.), aldehydes, and various other hardeners as described in U.S. Pat. No. 6,190,822 (Dickerson et al.).

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of about 10% by weight to about 90% by weight, and more preferably at a level of about 20% by weight to about 70% by weight, based on the total dry weight of the layer in which it is included. The amount of binders on opposing sides of the support in double-sided materials may be the same or different.

Support Materials

The photothermographic materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use supports comprising dichroic mirror layers as described in U.S. Pat. No. 5,795,708 (Boutet), incorporated herein by reference.

Also useful are transparent, multilayer, polymeric supports comprising numerous alternating layers of at least two different polymeric materials that preferably reflect at least 50% of actinic radiation in the range of wavelengths to which the photothermographic material is sensitive. Such polymeric supports are described in U.S. Pat. No. 6,630,283 (Simpson et al.) that is incorporated herein by reference.

Support materials can contain various colorants, pigments, antihalation or acutance dyes if desired. For example, blue-tinted supports are particularly useful for providing images useful for medical diagnosis or other adhesion-promoting layers can be used.

Photothermographic Formulations

In less preferred embodiments, an organic solvent-based coating formulation for the emulsion layer(s) can be prepared by mixing the emulsion components with one or more hydrophobic binders in a suitable solvent system that usually includes an organic solvent, such as toluene, 2-butanone (methyl ethyl ketone), acetone, or tetrahydrofuran.

Alternatively and preferably, the emulsion components are prepared in a formulation containing a hydrophilic binder (such as gelatin, a gelatin-derivative, or a cellulosic material) or a water-dispersible polymer in the form of a latex to provide aqueous-based coating formulations.

The photothermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic or organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The photothermographic materials can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.).

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.).

Additional conductive compositions include one or more fluoro-chemicals described in more detail in U.S. Patent Application Publication 2004/0067454 (Sakizadeh et al.).

Layers to promote adhesion of one layer to another are also known, as described in U.S. Pat. No. 5,891,610 (Bauer et al.), U.S. Pat. No. 5,804,365 (Bauer et al.), U.S. Pat. No. 4,741,992 (Przezdziecki), and U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Pat. No. 6,746,831 (Hunt).

The formulations described herein (including the emulsion formulations) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740, (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford) all of which are incorporated herein by reference. A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

For example, after or simultaneously with application of the emulsion formulation to the support, a protective overcoat formulation can be applied over the emulsion formulation(s).

Preferably, two or more layer formulations are applied simultaneously to a film support using slide coating, the first layer being coated on top of the second layer while the second layer is still wet, using the same or different solvents.

In other embodiments, a "carrier" layer formulation comprising a single-phase mixture of the two or more polymers described above may be applied directly onto the support and thereby located underneath the emulsion layer(s) as described in U.S. Pat. No. 6,355,405 (Ludemann et al.). Preferably, a carrier layer formulation is applied simultaneously with application of the emulsion layer formulation(s).

Mottle and other surface anomalies can be reduced in the materials by incorporation of a fluorinated polymer as described in U.S. Pat. No. 5,532,121 (Yonkoski et al.) or by using particular drying techniques as described in U.S. Pat. No. 5,621,983 (Ludemann et al.).

It is preferred that the photothermographic materials include the same or different emulsion layers on both sides of the support. In such materials, the non-imaging layers on both sides of the support (such as the antihalation layers) can also be the same or different in composition and thickness.

To promote image sharpness, the photothermographic materials can contain one or more thermally developable imaging layers containing acutance dyes. These dyes are chosen to have absorption close to the exposure wavelength and are designed to absorb scattered light.

In some embodiments, the photothermographic materials include a surface protective layer over one or more imaging layers on one or both sides of the support. In other embodiments, the materials include a surface protective layer on the same side of the support as the one or more thermally developable imaging layers and a layer on the backside that includes an antihalation and/or conductive antistatic composition. A separate backside surface protective layer can also be included in these embodiments.

Antihalation Layers

An antihalation layer (or adjacent multiple layers) is located between the support and all thermally developable imaging layers on one or both sides of the support containing imaging layers. Preferably, the antihalation layers are on both sides of the support, between the support and the thermally developable imaging layers, and comprise essentially the same construction and composition (that is, "symmetric" imaging materials) so that sensitometric properties are essentially the same on both sides of the support.

As noted above, the antihalation layers comprise one or more radiation absorbing compounds that absorb most or all of the radiation at the predetermined wavelength (defined above). Generally, these radiation absorbing compounds are dyes or pigments that are present in an amount sufficient to provide an absorbance of at least 0.25 (preferably at least 0.3) at the predetermined wavelength. In practical terms, the amount of radiation absorbing compounds present in the photothermographic will vary depending upon the compound(s) used, extinction coefficient, and wavelength of the compounds. This can be readily determined using routine experimentation.

In preferred embodiments, the radiation absorbing compounds absorb as little as possible in the visible regions of the electromagnetic spectrum (that is over 410 nm) so little "color" stain is present to distort the resulting image.

Each antihalation layer contains a composition that includes one or more radiation absorbing compounds that are dispersed within one or more suitable binders such as those described in the "Binders" section of this application. Gelatin and gelatin derivatives are preferred binders.

Particularly useful radiation absorbing compounds are hydroxyphenylbenzotriazoles that can be represented by the following Structure (I):

(I)

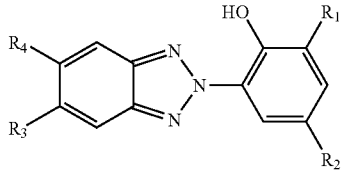

wherein $R_1$ and $R_2$ are independently alkyl, aryl, alkoxy, aryloxy, or alkenyl groups as long as at least one of $R_1$ and $R_2$ has at least 4 carbon atoms. $R_1$ and $R_2$ can be unsubstituted or substituted with one or more substituents that would not adversely affect the absorbance of the compound. The alkyl group can have from 4 to 22 carbon atoms and be an n-butyl, t-butyl, n-propyl, n-hexyl, or dodecyl group. The alkoxy group is similarly defined except that the alkyl group is attached through an oxy group. The aryl group can be phenyl or naphthyl and the aryloxy can be a phenyl or naphthyl attached through an oxy group. The alkenyl group can have from 4 to 22 carbon atoms and include radicals with the double bond located anywhere along the chain Preferably, $R_1$ and $R_2$ are independently the defined groups wherein at least one of them has at least 4 carbon atoms. Particularly useful groups include t-butyl, sec-butyl, t-pentyl, phenyl, phenoxy, n-hexoxy, and dodecyl groups.

$R_3$ and $R_4$ are independent hydrogen or a halo, alkyl, aryl, alkoxy, aryloxy, or alkenyl group as defined above for $R_1$ and $R_2$ except the groups can have 1 to 22 carbon atoms. Preferably, $R_3$ and $R_4$ are independently hydrogen, chloro, bromo, and the noted alkyl, aryl, alkoxy, aryloxy, and alkenyl groups having 4 to 8 carbon atoms. Particularly useful $R_3$ and $R_4$ groups include hydrogen, chloro, t-butyl, phenyl, and n-pentyl. It may also be useful that $R_3$ be hydrogen and $R_4$ be one of the noted preferred groups.

Representative examples of hydroxybenzotriazoles include Compound I-1 shown below as well as other compounds shown in Columns 3–5 of U.S. Pat. No. 4,540,656 (Nishizima et al.) that is incorporated herein by reference. It must be understood however, that while the compounds may fall within Structure (I), the compounds useful in this invention must also absorb radiation of the desired predetermined wavelength.

(I-1)

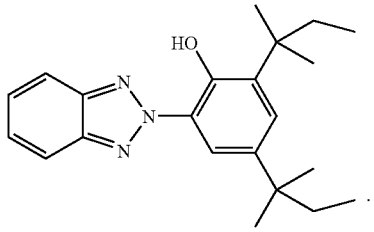

These compounds can be prepared using known procedures and starting materials, or purchased from several commercial sources. Compound I-1 can be purchased as Tinuvin 328 from Ciba Specialty Chemicals.

A less preferred class of crossover control agents includes hydroxyphenyltriazines that can be represented by the following Structure (II):

(II)

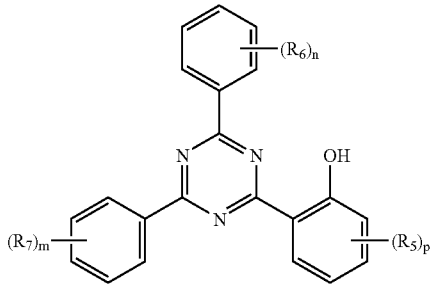

wherein $R_5$, $R_6$, and $R_7$ are the same or different substituents, and m, n, and p are independently 0, 1, 2, or 3. Preferably, m, n, and p are each 0, 1, or 2, and more preferably, each of them is 0 or 1. Compounds where the phenyl rings comprise one or more additional hydroxy or alkoxy groups may be preferred.

Unless otherwise specifically stated, use of the term "substituent" for Structure II means any group or radical other than hydrogen. Additionally, such substituents are also intended to encompass not only the unsubstituted substituent, but also substituents further substituted with any other group(s) as herein mentioned, so long as the substituent does not destroy properties necessary for the intended utility. Suitably, a substituent group may be halogen or may be bonded to the remainder of the molecule by an atom of carbon, silicon, oxygen, nitrogen, phosphorous, or sulfur. Useful substituents include, for example, halogen (such as chloro, bromo or fluoro), nitro, hydroxy, cyano, carboxy, or groups that may be further substituted, such as alkyl [including straight or branched chain or cyclic alkyl, such as methyl, trifluoromethyl, ethyl, t-butyl, 3-(2,4-di-t-pentylphenoxy) propyl], cyclohexyl, alkenyl (such as ethylene, and 2-butene), alkoxy (such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy, aryl (such as phenyl, 4-t-butylphenyl, 2,4,6-trimethylphenyl, and naphthyl), aryloxy (such as phenoxy, 2-methylphenoxy, alpha- or beta-naphthyloxy, and 4-tolyloxy), carbonamido [such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido], sulfonamido (such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido), sulfamoyl [such as N-methylsulfamoyl, N-ethylsulfamoyl, N,N-dipropylsulfamoyl, N-hexadecylsulfamoyl, N,N-dimethylsulfamoyl, N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl]. Carbamoyl (such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl), acyl [such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl], sulfonyl (such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl), sulfonyloxy (such as dodecylsulfonyloxy, and hexadecylsulfonyloxy), sulfonyl (such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl), thio (such as ethylthio, octylthio, benzylthio, tetradecylthio, 2-(2,4-di-t-pentylphenoxy)ethylthio, phenylthio, 2-butoxy-5-t-octylphenylthio, and p-tolylthio), acyloxy (such as acetyloxy, benzoyloxy, octadecanoyloxy, p-dodecylamidobenzoyloxy, N-phenylcarbamoyloxy, N-ethylcarbamoyloxy, and cyclohexylcarbonyloxy), amine (such as phenylanilino, 2-chloroanilino, diethylamine, and dodecylamine), imino [such as 1 (N-phenylimido)ethyl, N-succinimido or 3-benzylhydantoinyl], phosphate (such as dimethylphosphate and ethylbutylphosphate), phosphite (such as diethyl- and dihexylphosphite), a heterocyclic group, a heterocyclic oxy group or a heterocyclic thio group, each of which may be substituted and that contains a 3- to 7-membered heterocyclic ring composed of carbon atoms and at least one hetero atom selected from the group consisting of oxygen, nitrogen and sulfur (such as 2-furyl, 2-thienyl, 2-benzimidazolyloxy or 2-benzothiazolyl), quaternary ammonium (such as triethylammonium), and silyloxy (such as trimethylsilyloxy).

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided.

Preferably, $R_5$, $R_6$, and $R_7$ are independently alkyl, alkoxy (for example having 3 or more carbon atoms), or hydroxy groups. Ester groups are also useful. U.S. Pat. No. 6,184,375 (Hüglin et al.) and GB 2,319,523 (Hüglin et al.) are incorporated herein by reference for describing a number of potentially useful compounds but some experimentation may be needed by a skilled artisan to determine if a particular hydroxyphenyltriazine absorbs appropriately at the predetermined wavelength and if it leaves minimal "stain" (such as yellow stain) in the resulting image.

Representative hydroxyphenyltriazines include the following Compounds II-1 to II-5:

(II-1)

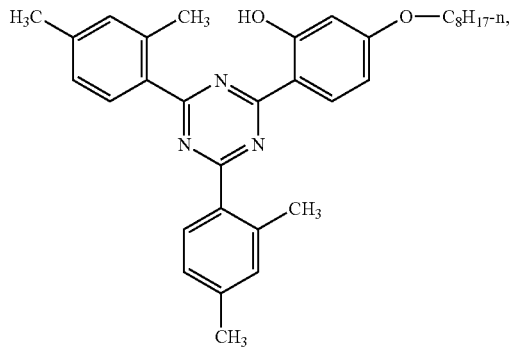

(II-2)

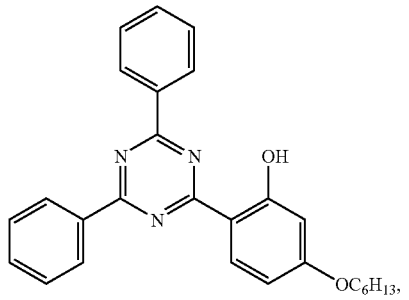

(II-3)

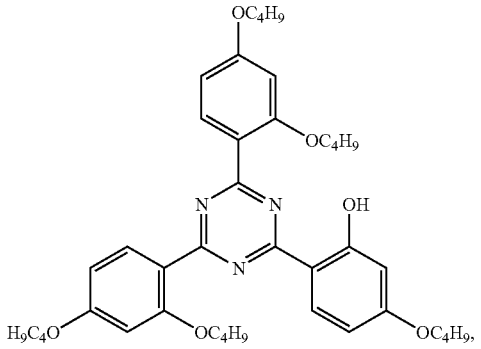

(II-4)

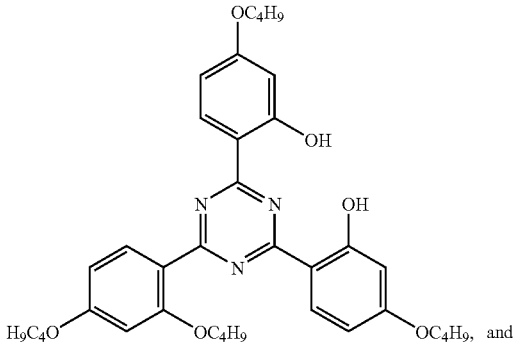

-continued (II-5)

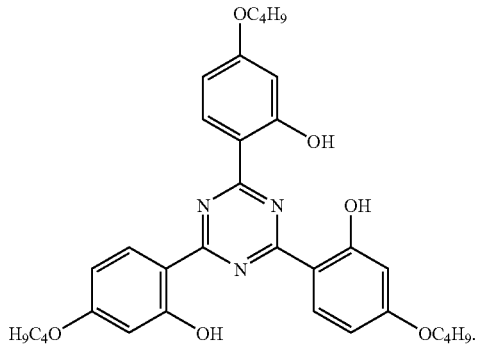

The hydroxyphenyltriazines can be prepared from conventional starting materials and using known procedures. Alternatively, they can be purchased from several sources. For example, Compound II-1 can be purchased as Cyasorb UV-1164 from Cytec Industries.

Also particularly useful in this invention is one or more dibenzoylmethanes that can be represented by the following Structure (III):

(III)

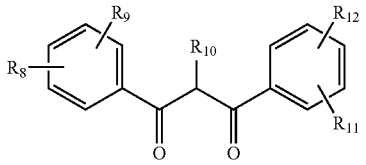

where $R_8$ through $R_{12}$ are each independently hydrogen, halogen, nitro, or hydroyxl groups, or substituted or unsubstituted alkyl, alkenyl, aryl, alkoxy, acyloxy, ester, carboxyl, alkyl thio, aryl thio, alkylamine, arylamine, alkylnitrile, arylnitrile, arylsulfonyl, or 5- or 6-member heterocyclic groups. Further details of such compounds. Preferably, each of such aliphatic $R_8$ through $R_{12}$ groups has no more than 20 carbons and can be branched or unbranched.

In preferred embodiments, the dibenzoylmethanes can be represented by the following Structure (III-A):

(III-A)

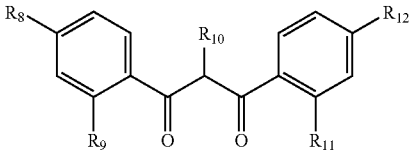

wherein $R_8$ and $R_{12}$ are independently substituted or unsubstituted alkyl or alkoxy groups having 1 to 6 carbon atoms (branched or unbranched) and $R_9$ through $R_{11}$ are hydrogen atoms.

Representative compounds of Formula (III) that may be used in this invention include the following:

(III-1): 4-(1,1-dimethylethyl)-4'-methoxydibenzoylmethane (PARSOL 1789 available from Roche Vitamins), (III-2): 4-isopropyl dibenzoylmethane (EUSOLEX 8020 available from Merck KGaA), and (III-3): dibenzoylmethane (RHODIASTAB 83 available Rhodia).

Compound III-1 can be represented by the following Structure (III-1):

(III-1)

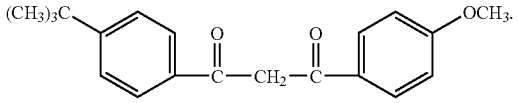

Imaging/Development

The photothermographic materials can be imaged in any suitable manner consistent with the type of material, using any suitable imaging source (typically some type of radiation or electronic signal). In some embodiments, the materials are sensitive to radiation in the range of from about at least 300 nm to about 1400 nm, and preferably from about 300 nm to about 450 nm because of the use of appropriate spectral sensitizing dyes. In one preferred embodiment, the materials are sensitive to radiation of from about 360 nm to about 420 nm.

Imaging can be achieved by exposing the photothermographic materials to a suitable source of radiation to which they are sensitive, including ultraviolet radiation, visible light, near infrared radiation and infrared radiation to provide a latent image. Suitable exposure means are well known and include incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure*, item 38957 (noted above).

In preferred embodiments, the photothermographic materials are imaged using an X-radiation imaging source and one or more prompt-emitting or storage X-ray sensitive phosphor screens adjacent to the photothermographic material. The phosphors emit suitable radiation at the predetermined wavelength to expose the photothermographic material.

Thermal development conditions will vary, depending on the construction used but will typically involve heating the thermally sensitive material at a suitably elevated temperature, for example, at from about 50° C. to about 250° C. for a sufficient period of time, generally from about 1 to about 120 seconds. Heating can be accomplished using any suitable heating means. A preferred heat development procedure for photothermographic materials described herein includes heating at from 130° C. to about 170° C. for from about 10 to about 25 seconds. A particularly preferred development procedure is heating at about 150° C. for 15 to 25 seconds.

Imaging Assemblies

In preferred embodiments, the photothermographic materials are used in association with one or more phosphor intensifying screens and/or metal screens in what is known as "imaging assemblies." Double-sided X-radiation sensitive photothermographic materials are preferably arranged in association with two adjacent intensifying screens, one screen in the "front" and one screen in the "back" of the material. The front and back screens can be appropriately chosen depending upon the type of emissions desired, the desired photicity, emulsion speeds, and percent crossover. A metal (such as copper or lead) screen can also be included if desired.

There are a wide variety of phosphors known in the art that can be formulated into phosphor intensifying screens as described in many publications including U.S. Pat. No. 6,573,033 (noted above) and references cited therein. In particular, the desired phosphors emit radiation to which the photothermographic material is sensitive, that is, within the range of from about 300 to about 450 nm, and preferably from about 360 to about 420 nm.

Preferred phosphors useful in the phosphor intensifying screens include one or more alkaline earth fluorohalide phosphors and especially the rare earth activated (doped) alkaline earth fluorohalide phosphors. Particularly useful phosphor intensifying screens include an europium-doped barium fluorobromide ($BaFBr_2$:Eu) phosphor. Other useful phosphors are described in U.S. Pat. No. 6,682,868 (Dickerson et al.) and references cited therein, all incorporated herein by reference.

The following examples are provided to illustrate the practice of the present invention and the invention is not meant to be limited thereby.

Materials and Methods for the Examples:

All materials used in the following examples can be prepared using known synthetic procedures or are readily available from standard commercial sources, such as Aldrich Chemical Co. (Milwaukee, Wis.) unless otherwise specified. All percentages are by weight unless otherwise indicated.

Densitometry measurements were carried out on an X-Rite® Model 301 densitometer that is available from X-Rite Inc. (Grandville, Mich.).

Compound A-1 is described in U.S. Pat. No. 6,605,418 (noted above) and is believed to have the following structure.

(A-1)

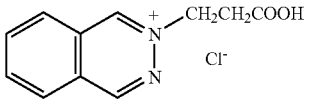

Compound SS-1a is described in U.S. Pat. No. 6,296,998 (Eikenberry et al.) and is believed to have the following structure.

(SS-1a)

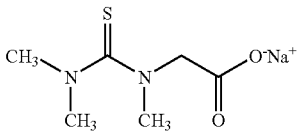

Blue sensitizing dye SSD-1 is believed to have the following structure.

(SSD-1)

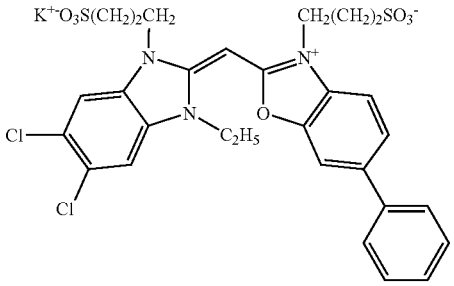

EXAMPLE 1

Aqueous-based photothermographic materials of this invention were prepared in the following manner.

Preparation of Silver Benzotriazole Dispersion:

Solution A was prepared in a stirred reaction vessel by dissolving 85 g of lime-processed gelatin and 25 g of phthalated gelatin in 2000 g of deionized water.

Solution B containing 185 g of benzotriazole, 1405 g of deionized water, and 680 g of a 2.5 molar solution of sodium hydroxide was prepared. The mixture in the reaction vessel was adjusted to a pAg of 7.25 and a pH of 8.0 by addition of 2.5 molar sodium hydroxide solution as needed, and maintaining it at temperature of 36° C.

Solution C containing 228.5 g of silver nitrate and 1222 g of deionized water was added to the reaction vessel at an accelerated flow rate defined by: $Flow=16(1+0.002t^2)$ ml/min (where t is the time in minutes), and the pAg was maintained at 7.25 by simultaneous addition of Solution B. This process was terminated when Solution C was exhausted, at which point Solution D containing 80 g of phthalated gelatin and 700 g of deionized water at 40° C. was added to the reaction vessel. The mixture was then stirred and the pH was adjusted to 2.5 with 2 molar sulfuric acid to coagulate the silver salt emulsion. The coagulum was washed twice with 5 liters of deionized water, and redispersed by adjusting pH to 6.0 and pAg to 7.0 with 2.5 molar sodium hydroxide solution and Solution B. The resulting dispersion contained fine particles of silver benzotriazole.

Tabular Grain Silver Halide Emulsion:

A tabular grain emulsion of silver iodobromide (4.2%: 95.8%) was prepared using a conventional method in gelatin binder (33 g/mol Ag). The tabular grains were spectrally sensitized using SSD-1 (3 mmol/mol Ag) and chemically sensitized using sodium aurousdithiosulfate, sodium dihydrate (12.5 $cm^3$/mol Ag). A solution of acetamidophenylmercaptotetrazole (2 $cm^3$/mol Ag) was added after chemical sensitization.

The resulting emulsion was examined by Scanning Electron Microscopy. Tabular grains accounted for greater than 99% of the total projected area. The mean ECD of the grains was 2.8 μm. The mean tabular thickness was 0.06 μm.

Preparation of Photothermographic Materials:

Solution A: A portion of the tabular-grain silver halide emulsion prepared above was placed in a vessel and mixed with poly(styrene-co-methyl methacrylate) matte beads.

Solution B: Silver benzotriazole and gelatin (35% gelatin/65% water) were placed in a vessel and mixed with 3-methylbenzothiazolium iodide, ZONYL FSN surfactant and sulfuric acid.

Solution C: Compound T-2, dimethylurea, succinimide, phthalazinium, 2-(2-carboxyethyl)-, chloride, pentaerythritol, citric acid, L-ascorbic acid, 6-(2,2-dimethylpropanoate), and a 10% (weight) of poly(vinyl alcohol) were mixed.

Solutions A, B, and C were mixed immediately before coating to form a photothermographic emulsion formulation.

Antihalation compositions were prepared with various dyes in gelatin and coated as a single layer on a 7 mil (178 μm) transparent, blue-tinted poly(ethylene terephthalate) film support. The photothermographic emulsion formulation was coated over the dried antihalation composition to provide Photothermographic Film A (Control) having the dry coverage from Solutions A, B, and C shown in the following TABLE II.

TABLE II

| | | mg/ft$^2$ | mg/m$^2$ |
|---|---|---|---|
| Solution A | Silver | 31.6 | 341 |
| | Gelatin | 68.3 | 734 |
| | Matte beads | 2.5 | 27 |
| Solution B | Silver | 154.5 | 1661 |
| | Gelatin | 131.6 | 1415 |
| | 3-Methyl-benzothiazolium iodide | 7.77 | 84 |
| | 1,2,3-Benzotriazole | 7.79 | 84 |
| | ZONYL FSN surfactant | 5.22 | 56 |
| | Sulfuric acid | 38.66 | 416 |
| Solution C | 3H-1,2,4-Triazole-3-thione, 2,4-dihydro-4-(phenylmethyl), compound "T-2" | 7 | 75 |
| | Dimethylurea | 15.41 | 166 |
| | Succinimide | 12.32 | 132 |
| | Phthalazinium, 2-(2-carboxyethyl)-, chloride | 6.16 | 66 |
| | Pentaerythritol | 56.35 | 606 |
| | Citric Acid | 23.32 | 251 |
| | L-Ascorbic acid, 6-(2,2-dimethylpropanoate) | 6.16 | 66 |
| | 10% PVA solution | 22 | 237 |

Photothermographic Film B (Comparative) was prepared similarly to Film A except that an antihalation layer was disposed between the support and the photothermographic emulsion layer. This antihalation layer comprised the "LUV" dye (shown below) at 15 mg/ft$^2$ (162 mg/m$^2$) in 125 mg of gel/ft$^2$ (1.35 g/m$^2$). "LUV" dye is not a radiation absorbing compound within the scope of the present invention.

Photothermographic Film C (Comparative) was prepared like Film B except the "LUV" dye was present in the antihalation layer at 30 mg/ft$^2$ (324 mg/m$^2$).

Photothermographic Film D (Invention) was prepared like Film B except that the antihalation layer comprised radiation absorbing compound II-1 at 15 mg/ft$^2$ (162 mg/m$^2$).

Photothermographic Film E (Invention) was prepared like Film D except radiation absorbing compound II-1 was present in the antihalation layer at 30 mg/ft$^2$ (324 mg/m$^2$).

Photothermographic Film F (Invention) was prepared like Film D except that radiation absorbing compound I-1 was used in the antihalation layer at 15 mg/ft$^2$ (162 mg/m$^2$).

Photothermographic Film G was prepared like Film F except that radiation absorbing compound I-1 was used in the antihalation layer at 30 mg/ft$^2$ (324 mg/m$^2$).

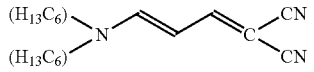

"LUV" dye

Samples of each of the Films A–G were exposed through a graduated density step tablet to a MacBeth sensitometer for 1/50th second to a 500 watt General Electric DMX projector lamp calibrated to 2650° K., filtered with a Corning filter to simulate a blue emitting X-radiation phosphor screen exposure.

The exposed films were thermally processed using a flatbed thermal processor at 150° C. for 18 seconds.

The resulting optical densities of the images in the films were expressed in terms of diffuse density as measured by an X-rite Model 310™ densitometer that was calibrated to ANSI standard PH 2.19 and was traceable to a National Bureau of Standards calibration step tablet. The characteristic curve (density vs. log E) was plotted for each of Films A–G. Photospeed was measured at a density of 1.0+$D_{min}$ and the Control Film A designated a relative photospeed of 463. The density at 388 nm was also measured. It is desired that this density be at least 0.2.

"Image Tone is a measure of the color of the developed silver as viewed by transmission. The values are determined by CIELAB standards for spectra recorded from 400–700 nm using D5500 as the standard illuminant. Image tone is the b* value from the CIELAB measurement and is a measure of the yellow-blue color balance. The more negative the number the more blue the developed silver image appears. Warm (more positive b* values) is judged by many radiologists to be undesirable. A difference of 0.7 b* units is considered a just noticeable difference for a standard observer. It is desired that image tone is more negative than a value of 1.2.

"Edge sharpness" was measured as follows:

Using two phosphor intensifying screens containing a $BaFBr_2$:Eu phosphor (Nichia NP 3051014), an unprocessed sample of each unexposed film was placed against a "front" screen (imaging layer toward the screen). A second sample of the same film was placed with the imaging layer towards a "back" screen. The phosphor intensifying screens were prepared with the phosphor (432 g/m$^2$) dispersed in a polyurethane binder (Permuthane U6366 from Stahl Corp., 20.6 g/m$^2$) to provide a phosphor layer on a poly(ethylene terephthalate) film support. The weight ratio of phosphor to binder was 21:1 and the phosphor layer included 17 ppm of carbon. The phosphor layer had been overcoated with a protective layer comprising cellulose acetate (10 g/m$^2$).

This imaging assembly simulates the use of a duplitized photothermographic material that is imaged between the two phosphor intensifying screens. The films in the imaging assemblies were imagewise exposed and thermally processed as described above to provide two images for each of Films A–G. The higher value for edge sharpness indicates subjectively improved image quality.

The results of the various tests are shown below in TABLE III for each of the photothermographic films.

TABLE III

| Film | Crossover Control Agent | Photo-speed | Density at 388 nm | Image Tone | Edge Sharp-ness |
|---|---|---|---|---|---|
| A (Control) | 0 | 463 | 0.16 | 0.3 | 0 |
| B (Comparative) | "LUV" Dye | 454 | 0.83 | 1.7 | 10 |
| C (Comparative) | "LUV" Dye | 442 | 0.87 | 2.3 | 10 |
| D (Invention) | II-1 | 445 | 0.2 | 0.2 | 1 |
| E (Invention) | II-1 | 433 | 0.2 | 0.2 | 1 |
| F (Invention) | I-1 | 455 | 0.3 | 0.6 | 7 |
| G (Invention) | I-1 | 488 | 0.42 | 1.2 | 7 |

The data in TABLE III show that Films F and G provided adequate absorbance at 388 nm that is suitable for use with the specific phosphor used in the phosphor screens identified above. Their image tone was also acceptable.

Films D and E also had acceptable photospeed but because radiation absorbing compound II-1 absorbs at a lower wavelength (about 350 nm), II-1 is not the best radiation absorbing compound to use with the $BaFBr_2$:Eu phosphor. However, it may be optimally used in combination with a different emitting phosphor.

Comparative Films B and C exhibited poor image tone bur good edge sharpness because the "LUV" dye absorbs at longer wavelengths and its absorption extends too far into the visible spectrum, resulting in undesirable yellow dye stain.

EXAMPLE 2

Photothermographic materials were prepared like those described in Example 1 except that different radiation absorbing compounds were used.

Photothermographic Film H was prepared like Film A except that 15 mg/ft$^2$ (162 mg/m$^2$) of radiation absorbing compound III-1 was present in the antihalation layer.

Photothermographic Film I was prepared like Film H except that 30 mg/ft$^2$ (324 mg/m$^2$) of radiation absorbing compound III-1 was present in the antihalation layer.

Films H and I were exposed, heat processed and evaluated as described in Example 1. The results of the various tests are shown below in TABLE IV for each of the photothermographic films. The data from Example 1 for Films A–G is shown again for comparative purposes.

TABLE IV

| Film | Crossover Control Agent | Photo-speed | Density at 388 nm | Image Tone | Edge Sharp-ness |
|---|---|---|---|---|---|
| A (Control) | 0 | 463 | 0.16 | 0.3 | 0 |
| B (Comparative) | "LUV" Dye | 454 | 0.83 | 1.7 | 10 |
| C (Comparative) | "LUV" Dye | 442 | 0.87 | 2.3 | 10 |
| D (Invention) | II-1 | 445 | 0.2 | 0.2 | 1 |
| E (Invention) | II-1 | 433 | 0.2 | 0.2 | 1 |
| F (Invention) | I-1 | 455 | 0.3 | 0.6 | 7 |
| G (Invention) | I-1 | 488 | 0.42 | 1.2 | 7 |
| H (Invention) | III-1 | 455 | 0.6 | −0.2 | 10 |
| I (Invention) | III-1 | 443 | 0.8 | 0.4 | 10 |

The data in TABLE IV show that Films H and I provided adequate absorbance at 388 nm that is suitable for use with the specific phosphor used in the phosphor screens identified above. The radiation absorbing compounds used in these films provided excellent sharpness with little or no increase in image tone.

The invention has been described in detail with particular reference to certain preferred embodiments thereof, but it will be understood that variations and modifications can be effected within the spirit and scope of the invention.

The invention claimed is:

1. A black-and-white photothermographic material comprising a transparent support having on a frontside thereof, one or more frontside thermally developable imaging layers comprising a binder, and in reactive association, a photosensitive silver halide that is spectrally sensitized to a predetermined wavelength within a predetermined wavelength range of from 300 to about 450 nm, a non-photosensitive source of reducible silver ions, a reducing agent for said non-photosensitive reducible silver ions, and optionally an outermost protective layer disposed over said one or more thermally developable imaging layers, said material comprising on the backside of said support, one or more backside thermally developable imaging layers comprising binder, and in reactive association, a photosensitive silver halide that is spectrally sensitized to a predetermined wavelength within a predetermined wavelength range of from 300 to about 450 nm, a non-photosensitive source of reducible silver ions, a reducing agent for said non-photosensitive reducible silver ions, and optionally an outermost protective layer disposed over said one or more thermally developable imaging layers, said material further comprising an antihalation layer on at least one side of said support, said antihalation layer being interposed between said support and said one or more thermally developable imaging layers on at least one side of said support, said antihalation layers on at least one side of said support having the same or different composition and comprising a UV-radiation absorbing compound that absorbs UV-radiation at a wavelength of less than or equal to 410 nm.

2. The material of claim 1 wherein said antihalation layer comprises a hydroxyphenylbenzotriazole, hydroxyphenyltriazine, dibenzoylmethane, or mixture thereof.

3. The material of claim 1 that is spectrally sensitized to a predetermined wavelength within a predetermined range of from about 360 to about 420 nm.

4. The material of claim 1 wherein said UV-radiation absorbing compound comprises a hydroxyphenylbenzotriazole represented by the following Structure (I):

(I)

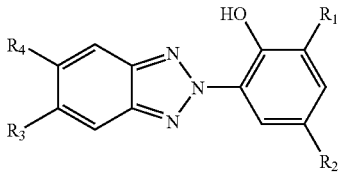

wherein $R_1$ and $R_2$ are independently alkyl, aryl, alkoxy, aryloxy, or alkenyl groups wherein at least one of the $R_1$ and $R_2$ groups has at least 4 carbon atoms, and $R_3$ and $R_4$ are independently hydrogen or a halo, alkyl, aryl, alkoxy, aryloxy, or alkenyl group.

5. The material of claim 4 wherein $R_1$ and $R_2$ are independently the defined groups having 4 to 8 carbon atoms, $R_3$ is hydrogen, and $R_4$ is hydrogen, chloro, bromo, or an alkyl, aryl, alkoxy, aryloxy, or alkenyl group having 4 to 8 carbon atoms.

6. The material of claim 1 wherein said UV-radiation absorbing compound comprises a hydroxyphenyltriazine represented by the following Structure (II):

(II)

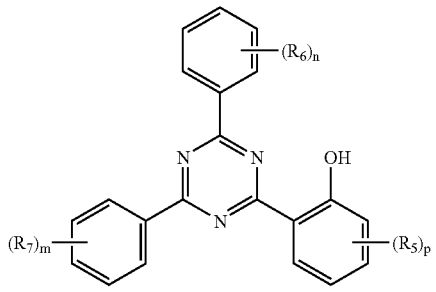

wherein $R_5$, $R_6$, and $R_7$ are the same or different substituents, and m, n, and p are independently 0, 1, 2, or 3.

7. The material of claim 6 wherein $R_5$, $R_6$, and $R_7$ are independently alkyl, alkoxy, or hydroxy groups.

8. The material of claim 6 wherein at least one of $R_5$, $R_6$, and $R_7$ is an alkoxy group having at least 3 carbon atoms.

9. The material of claim 1 wherein said UV-radiation absorbing compound comprises a dibenzoylmethane represented by the following Structure (III):

(III)

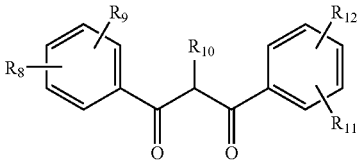

where $R_8$ through $R_{12}$ are each independently hydrogen, halogen, nitro, or hydroxyl, or alkyl, alkenyl, aryl, alkoxy, acyloxy, ester, carboxyl, alkyl thio, aryl thio, alkyl amine, aryl amine, alkyl nitrile, aryl nitrile, arylsulfonyl, or 5- or 6-member heterocyclic groups.

10. The material of claim 9 wherein said dibenzoylmethane is represented by the following Structure (III-A):

(III-A)

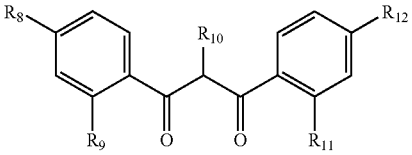

wherein $R_8$ and $R_{12}$ are independently alkyl or alkoxy groups having 1 to 6 carbon atoms and $R_9$ through $R_{11}$ are hydrogen atoms.

11. The material of claim 1 wherein said UV-radiation absorbing compound comprises one or more of the following compounds:

(I-1)

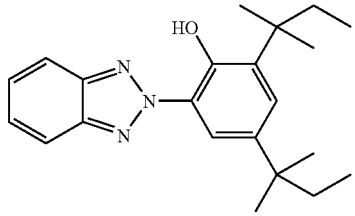

(II-1)

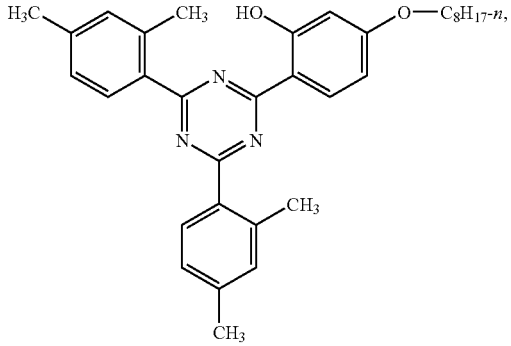

(II-2)

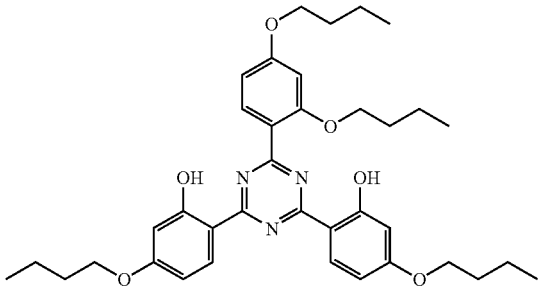

, and (III-1)

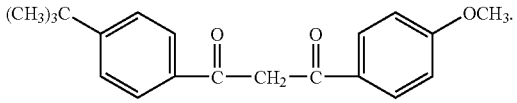

12. The material of claim 1 wherein said UV-radiation absorbing compound is present in an amount sufficient to provide an absorbance of at least 0.25 at said predetermined wavelength.

13. The material of claim 1 wherein said reducing agent is present in an amount of from about 0.3 to about 1.0 mol/mol of total silver and is an ascorbic acid or reductone.

14. The material of claim 1 further comprising a phosphor in at least one of said thermally developable imaging layers.

15. The material of claim 1 wherein said source of reducible silver ions comprises a silver salt of a heterocyclic compound containing an imino group.

16. The material of claim 1 wherein said non-photosensitive source of reducible silver ions includes a silver salt of benzotriazole or a substituted derivative thereof, or mixtures of such silver salts, said material is an aqueous-based material and comprises predominantly one or more hydrophilic binders or one or more water-dispersible polymeric latex binders in said one or more thermally developable imaging layers, and said photosensitive silver halide comprises one or more preformed photosensitive silver halides that are provided predominantly as tabular grains.

17. The material of claim 1 comprising one or more toners at least one of which is a mercaptotriazole, triazine thione, phthalazine, or phthalazine derivative.

18. The material of claim 1 further comprising one or more of the same or different thermally developable imaging layers on both sides of said support and the same or different antihalation layer interposed between said support and the one or more thermally developable imaging layers on both sides of said support.

19. An imaging assembly comprising the photothermographic material of claim 1 that is arranged in association with one or more phosphor intensifying screens, said one or more phosphor intensifying screens having a phosphor composition that will emit radiation at a predetermined wavelength within a predetermined wavelength range of from 300 to about 450 nm.

20. A method of forming a black-and-white image comprising exposing the imaging assembly of claim 19 to X-radiation.

21. A method of forming a visible image comprising:

A) imagewise exposing the photothermographic material of claim 1 to form a latent image, B) simultaneously or sequentially, heating said exposed photothermographic material to develop said latent image into a visible image.

22. The method of claim 21 wherein said image-forming method further comprises:

C) positioning said exposed photothermographic material with the visible image therein between a source of imaging radiation and an imageable material that is sensitive to said imaging radiation, and D) exposing said imageable material to said imaging radiation through the visible image in said exposed and photothermographic material to provide an image in said imageable material.

23. The method of claim 21 wherein said imagewise exposing is carried out using visible or X-radiation.

24. The method of claim 23 wherein said photothermographic material is arranged in association with one or more phosphor intensifying screens during imaging.

25. The method of claim 21 comprising using said visible image for medical diagnosis.

26. A black-and-white aqueous-based photo-thermographic material that comprises a transparent support having on both sides thereof:

a) one or more thermally developable imaging layers each comprising a hydrophilic binder that is gelatin, a gelatin derivative, a poly(vinyl alcohol), or a cellulosic material, or is a water-dispersible polymeric latex, and in reactive association, a preformed photosensitive silver bromide, silver iodobromide, or a mixture thereof, provided predominantly as tabular grains, said tabular grains being spectrally sensitized to a predetermined wavelength within the predetermined range of wavelengths of from about 360 to about 420 nm, a non-photosensitive source of reducible silver ions that includes one or more organic silver salts at least one of which is a silver salt of benzotriazole, an ascorbic acid reducing agent for said non-photosensitive source of reducible silver ions, and b) optionally, an outermost protective layer disposed over said one or more thermally developable imaging layers, said material comprising an antihalation layer interposed between said one or more thermally developable imaging layers and said support, said antihalation layer comprising a UV-radiation absorbing compound, and said UV-radiation absorbing compound being one or more of the following compounds:

(I-1)

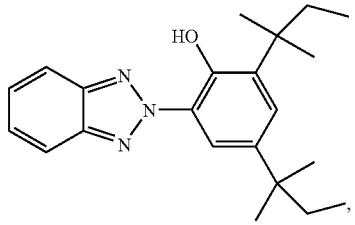

(II-1)

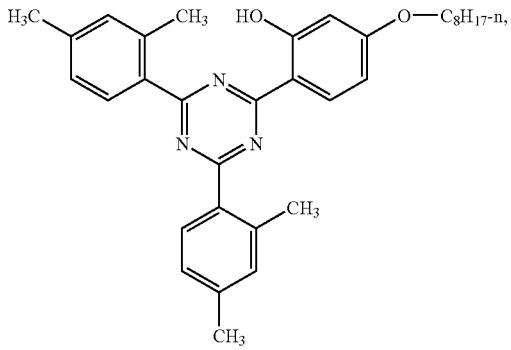

(II-2)

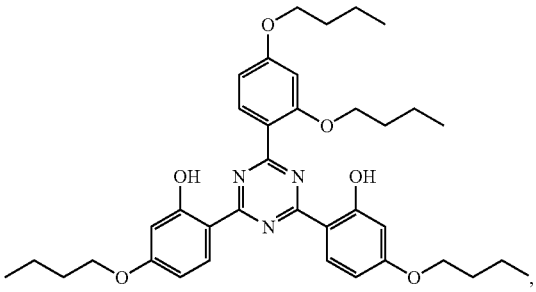

, and (III-1)

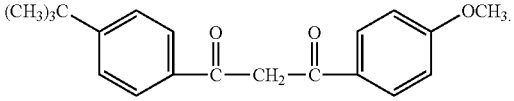

27. The material of claim 26 wherein said reducing agent comprises one or more of esters of ascorbic acid.

28. The material of claim 26 wherein said antihalation layer comprises said UV-radiation absorbing compound in an amount sufficient to provide an absorbance of at least 0.25 at said predetermined wavelength.

29. A black-and-white photothermographic material comprising a transparent support having on a frontside thereof, a) one or more frontside thermally developable imaging layers comprising a hydrophilic polymer binder or water-dispersible polymer latex binder, and in reactive association, a photosensitive silver halide that is spectrally sensitized to a predetermined wavelength within a predetermined range of wavelengths of from 360 to about 420 nm, a non-photosensitive source of reducible silver ions that includes a silver salt of a heterocyclic compound containing an imino group, an ascorbic acid or reductone reducing agent for said non-photosensitive source reducible silver ions, and said material comprising on the backside of said support, one or more backside thermally developable imaging layers comprising a hydrophilic polymer binder or a water-dispersible polymer latex binder, and in reactive association, a photosensitive silver halide that is spectrally sensitized to a predetermined wavelength within a predetermined range of wavelengths of from 360 to about 420 nm, a non-photosensitive source of reducible silver ions that includes a silver salt of a heterocyclic compound containing an imino group, and an ascorbic acid or reductone reducing agent for said non-photosensitive source reducible silver ions, and b) optionally, an outermost protective layer disposed over said one or more thermally developable imaging layers on either or both sides of said support, and wherein said one or more thermally developable imaging layers, or said one or more protective layers if present, on both sides of said support have the same or different composition, and said material further comprising an antihalation layer on both sides of said support, said antihalation layer being interposed between said support and said one or more thermally developable imaging layers on each side of said support, said antihalation layers on both sides of said support having the same or different composition and comprising a UV-radiation absorbing compound that absorbs radiation at a wavelength of less than 410 nm and is a hydroxyphenylbenzotriazole, hydroxyphenyltriazine, dibenzoylmethane, or mixture thereof.

30. The material of claim 29 wherein said antihalation layers on both sides of said support have the same composition.

31. The material of claim 29 wherein said antihalation layers comprise said UV-radiation absorbing compound in an amount sufficient to provide an absorbance of at least 0.25 at said predetermined wavelength.

32. The material of claim 29 wherein said non-photosensitive source of reducible silver ions includes a silver salt of benzotriazole or a substituted derivative thereof, or mixtures of such silver salts, said material is an aqueous-based material and comprises predominantly one or more hydrophilic binders or one or more water-dispersible polymeric latex binders in said one or more thermally developable imaging layers, said reducing agent comprises an ascorbic acid, said photosensitive silver halide comprises one or more preformed photosensitive silver halides that are provided predominantly as tabular grains, and said UV-radiation absorbing compound comprises one or more of the following compounds:

(I-1)

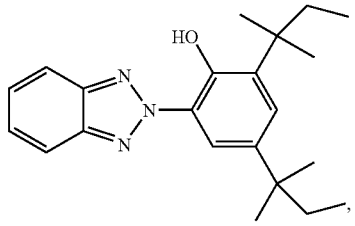

(II-1)

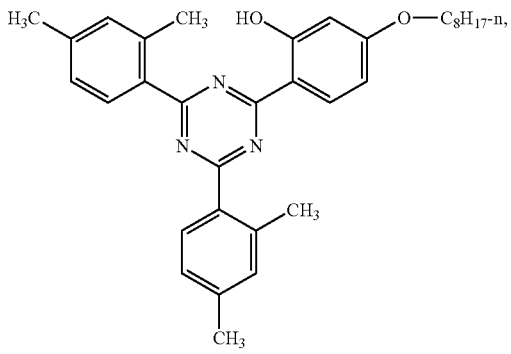

(II-2)

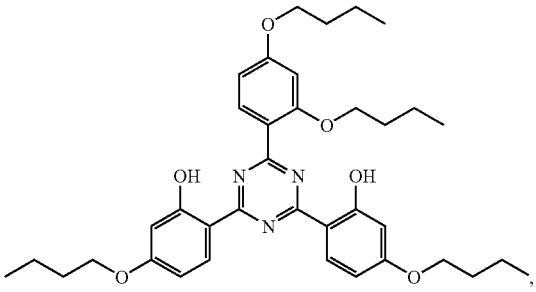

, and (III-1)

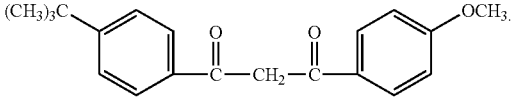

33. The material of claim 29 wherein said photosensitive silver halides are tabular grains having an aspect ratio of at least 3:1, a particle length less than 1 μm, and a particle width index less than 1.25.

34. A method of forming a visible image comprising:

A) imagewise exposing the photothermographic material of claim 29 to form a latent image, B) simultaneously or sequentially, heating said exposed photothermographic material to develop said latent image into a visible image.

* * * * *